US007735531B2

(12) United States Patent
Gilbert et al.

(10) Patent No.: US 7,735,531 B2
(45) Date of Patent: Jun. 15, 2010

(54) PLANING HEAD FOR A PLANING MACHINE AND METHOD OF MANUFACTURE THEREOF

(75) Inventors: Sylvain Gilbert, St-Prime (CA); Daniel Paré, St-Prime (CA)

(73) Assignee: Les Produits Gilbert Inc., Roberval, Quebec (CA)

( * ) Notice: Subject to any disclaimer, the term of this patent is extended or adjusted under 35 U.S.C. 154(b) by 405 days.

(21) Appl. No.: 11/891,482

(22) Filed: Aug. 10, 2007

(65) Prior Publication Data

US 2008/0115857 A1 May 22, 2008

Related U.S. Application Data

(60) Provisional application No. 60/836,679, filed on Aug. 10, 2006.

(51) Int. Cl.
*B27C 1/00* (2006.01)

(52) U.S. Cl. ..... 144/230; 407/41; 83/698.41; 241/91

(58) Field of Classification Search ..... 144/218, 144/220, 221, 230; 407/41, 49; 83/698.41, 83/698.51, 698.61; 241/91–93, 292.1, 293, 241/294

See application file for complete search history.

(56) References Cited

U.S. PATENT DOCUMENTS

| | | | | |
|---|---|---|---|---|
| 4,594,928 | A * | 6/1986 | Thomas et al. | 83/698.41 |
| 4,709,607 | A * | 12/1987 | Buhayar | 83/342 |
| 4,922,977 | A * | 5/1990 | Colton et al. | 144/230 |
| 5,904,193 | A | 5/1999 | Kellner | |
| 6,279,444 | B1 | 8/2001 | Kellner et al. | |
| 6,666,246 | B2 | 11/2003 | Gilbert | |

* cited by examiner

*Primary Examiner*—Shelley Self
(74) *Attorney, Agent, or Firm*—Merchant & Gould P.C.

(57) ABSTRACT

A planing head, cylindrical body for a planing head and a method of manufacture thereof are provided. The planing head includes a cylindrical body having an axis of rotation, an outer surface around the axis of rotation, and opposite first and second end faces. A plurality of blade assemblies is arranged along the outer surface. A plurality of grooves is provided in the outer surface and each groove is configured to receive a respective one of the plurality of blade assemblies. A hydraulic pressure system for supplying a hydraulic pressure to each of the blade assemblies is provided. The hydraulic pressure system includes a plurality of transverse channels for receiving a pressurised hydraulic fluid and a plurality of oblique channels hydraulically linking the plurality of transverse channels. Each transverse channel extends at least partially through the cylindrical body.

17 Claims, 4 Drawing Sheets

PLANING HEAD FOR A PLANING MACHINE AND METHOD OF MANUFACTURE THEREOF

FIELD OF THE INVENTION

The present invention relates to wood processing machinery. More particularly, the present invention relates to a planing head and a method of manufacture thereof.

BACKGROUND OF THE INVENTION

Planing machines are used in the lumber industry to plane lumber, giving different pieces of wood specific profiles. Automatic planing machines usually include a feed table, upper and lower planing heads, a linebar, and right and left side planing heads. The feed table is used for the preliminary vertical positioning of the lumber with respect to the upper and lower planing heads. The linebar is usually fixed and is used to laterally guide the lumber along a travelling course in the planing machine. The side planing heads, usually right and left, are used to plane the side surfaces of the lumber. They define a planing width therebetween. An example of an automated planing machine is disclosed in U.S. Pat. No. 6,666,246 (GILBERT).

Conventional planing heads generally include a cylindrical body and a plurality of blade receiving portions around its periphery. Such blade receiving portions generally include a transverse groove for receiving a wedge grip and blade. A wedge grip retains each blade within a groove and can translate radially therewithin. In use, the rotation of the planing head forces the wedge grips outward under the effect of the centrifugal force. In doing so, the wedge grips press against angled surfaces within each groove and the resultant force pushes the wedge grips toward their respective blades to hold them in place. When the planing head is at rest, the gripping effect is lessened and the blades can be removed as desired. The centrifugal effect can be complemented by additional components in or around the groove such as a mounting strip or a spring-loaded bolt (shown respectively in U.S. Pat. No. 5,904,193 (KELLNER) and U.S. Pat. No. 6,279,444 (KELLNER et al.)).

It is also known in the art to apply additional pressure from underneath the blades to complement the centrifugal effect. Channels are provided within the body of the planing head in which grease or oil is inserted and pressurised. Generally, a main channel forming a ring inside the cylindrical body of the planing head receives the grease or oil and distributes it to radial connecting channels under each blade. The grease or oil pressure pushes a piston outward under each wedge grip, thereby reinforcing the force of the wedge grip on the blade.

One drawback of this latter system is that the body of such a conventional planing head is manufactured from two concentric cylindrical pieces in order to form the main channel, which is provided at the junction between the two pieces. This adds complexity to the manufacturing process and involves higher costs than for a planing head body manufactured from a single piece. In addition, and as will be understood by one of ordinary skill in the art, a planing head body constructed from two concentric cylindrical pieces will not be as solid as a similarly sized one-piece construction.

There is therefore a need for an improved planing head and method of manufacture thereof which does not require the use of two concentric pieces in order to form the body of the planing head.

SUMMARY OF THE INVENTION

An object of the present invention is to provide a planing head for a planing machine which, by virtue of its design and components, satisfies some of the above-mentioned need and is thus an improvement over other related assemblies known in the prior art.

In accordance with a first aspect of the invention, there is provided a planing head for a planing machine. The planing head includes a cylindrical body having an axis of rotation, an outer surface around the axis of rotation, and opposite first and second end faces. A plurality of blade assemblies is arranged along the outer surface. A plurality of grooves is provided in the outer surface and each groove is configured to receive a respective one of the plurality of blade assemblies. Each groove extends parallel to the axis of rotation along the outer surface. A hydraulic pressure system for supplying a hydraulic pressure to each of the blade assemblies is provided. The hydraulic pressure system includes a plurality of transverse channels for receiving a pressurised hydraulic fluid and a plurality of oblique channels hydraulically linking the plurality of transverse channels. Each transverse channel extends at least partially through the cylindrical body from an opening in one of the first and second end faces towards the other of the first and second end faces. Each transverse channel is in hydraulic communication with a corresponding groove. Each oblique channel intersects a respective first of the plurality of transverse channels proximate to the opening in the one of the first and second end faces from which the first of the plurality of transverse channels extends. Each oblique channel intersects a respective neighbouring second transverse channel at a point farther towards the other of the first and second end faces.

For clarity's sake, it is noted that the expression "transverse" will be used herein to mean in a direction generally parallel to the central axis of the cylindrical body. Furthermore, it is noted that the designations of "first" and "second" will be used herein for convenience of reference only and are not representative of any particular order of importance or orientation.

In accordance with another aspect of the invention, there is provided a cylindrical body for a planing head. The cylindrical body includes an axis of rotation, an outer surface around the axis of rotation, and opposite first and second end faces. A plurality of grooves is provided in the outer surface, and each groove is configured to receive a blade assembly. Each groove extends parallel to the axis of rotation along the outer surface. A hydraulic pressure system is provided for supplying a hydraulic pressure to each of the plurality of grooves. The hydraulic pressure system includes a plurality of transverse channels for receiving a pressurised hydraulic fluid and a plurality of oblique channels hydraulically linking the plurality of transverse channels. Each transverse channel extends at least partially through the body from an opening in one of the first and second end faces towards the other of the first and second end faces. Each transverse channel is in hydraulic communication with a corresponding groove. Each oblique channel intersects a respective first of the plurality of transverse channels proximate to the opening in the one of the first and second end faces from which it extends. Each oblique channel intersects a respective second transverse channel at a point farther towards the other of the first and second end faces.

In a preferred embodiment, each blade assembly includes a blade and a wedge grip for retaining the blade within a respective one of the grooves. The wedge grip is operable to translate within the respective groove and to apply a retaining force to the blade in response to a force applied thereto.

Also in a preferred embodiment, the plurality of transverse channels includes a first set of the transverse channels which extend at least partially through the cylindrical body from an opening in the first end face, and a second set of the transverse channels which extend at least partially through the cylindrical body from an opening in the second end face.

Also in a preferred embodiment, the transverse channels of the first and second sets of transverse channels are disposed alternatingly on a circular locus about the central axis of rotation and each oblique channel hydraulically links one of the first set of transverse channels with an adjacent one of the second set of transverse channels.

In accordance with yet another aspect of the invention, there is also provided a method for manufacturing a cylindrical body for a planing head. A cylindrical body blank is provided having an axis of rotation, an outer surface around the axis of rotation, and opposite first and second end faces. A plurality of transverse channels is bored into the cylindrical body blank. Each transverse channel is bored at least partially through the cylindrical body blank from one of the first and second end faces towards the other of the first and second end faces. A plurality of oblique channels is then bored into the cylindrical body blank. Each oblique channel is bored from within a first transverse channel at a position proximate to the respective one of the first and second end faces and at an oblique angle thereto, such that the oblique channel intersects a second transverse channel at a point farther towards the other of the first and second end faces. A plurality of grooves in the outer surface is formed. The grooves extend parallel to the axis of rotation along the outer surface. A plurality of connecting channels is bored into the cylindrical body blank. Each connecting channel is bored from within a groove to a corresponding transverse channel.

Other aspects and features of the invention will be better understood upon reading of preferred embodiments of the invention with reference to the appended drawings.

DESCRIPTION OF PREFERRED EMBODIMENTS OF THE INVENTION

Figure 1:
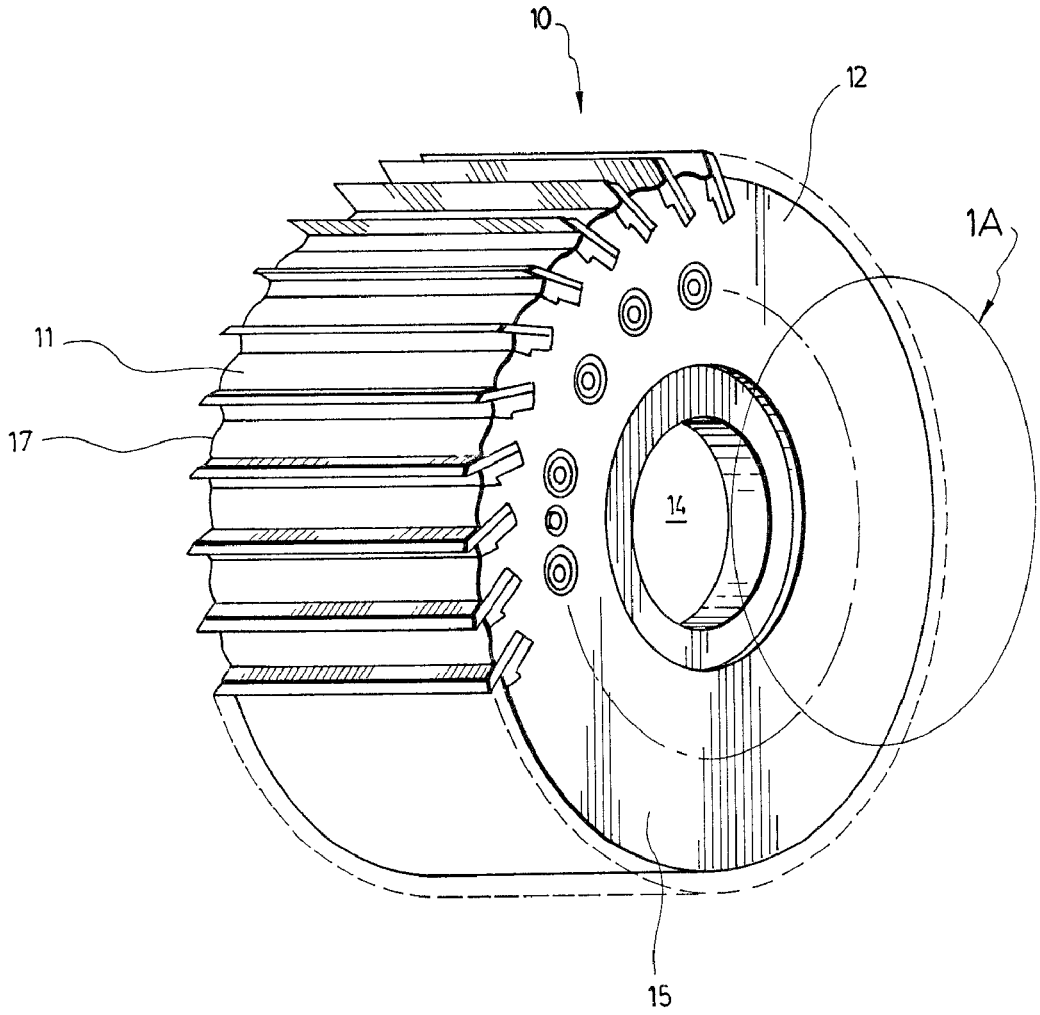
FIG. 1 is a perspective front view in partial transparency of a planing head according to a preferred embodiment of the invention.

Referring to FIG. 1, there is shown a planing head 10 according to a preferred embodiment of the invention. As will be understood by one skilled in the art, the planing head 10 of the present invention can be used as any one of the upper, lower, right side or left side planing heads of a planing machine, but is not limited thereto.

As is known in the art, the planing head 10 has a cylindrical body 12 which is generally symmetrical about its axis of rotation 13. A bore 14 is provided through the center of the body 12 parallel to the axis rotation 13. The cylindrical body 12 has an outer surface 11 which extends transversely between opposite first and second end faces 15 and 17.

Figure 1A:
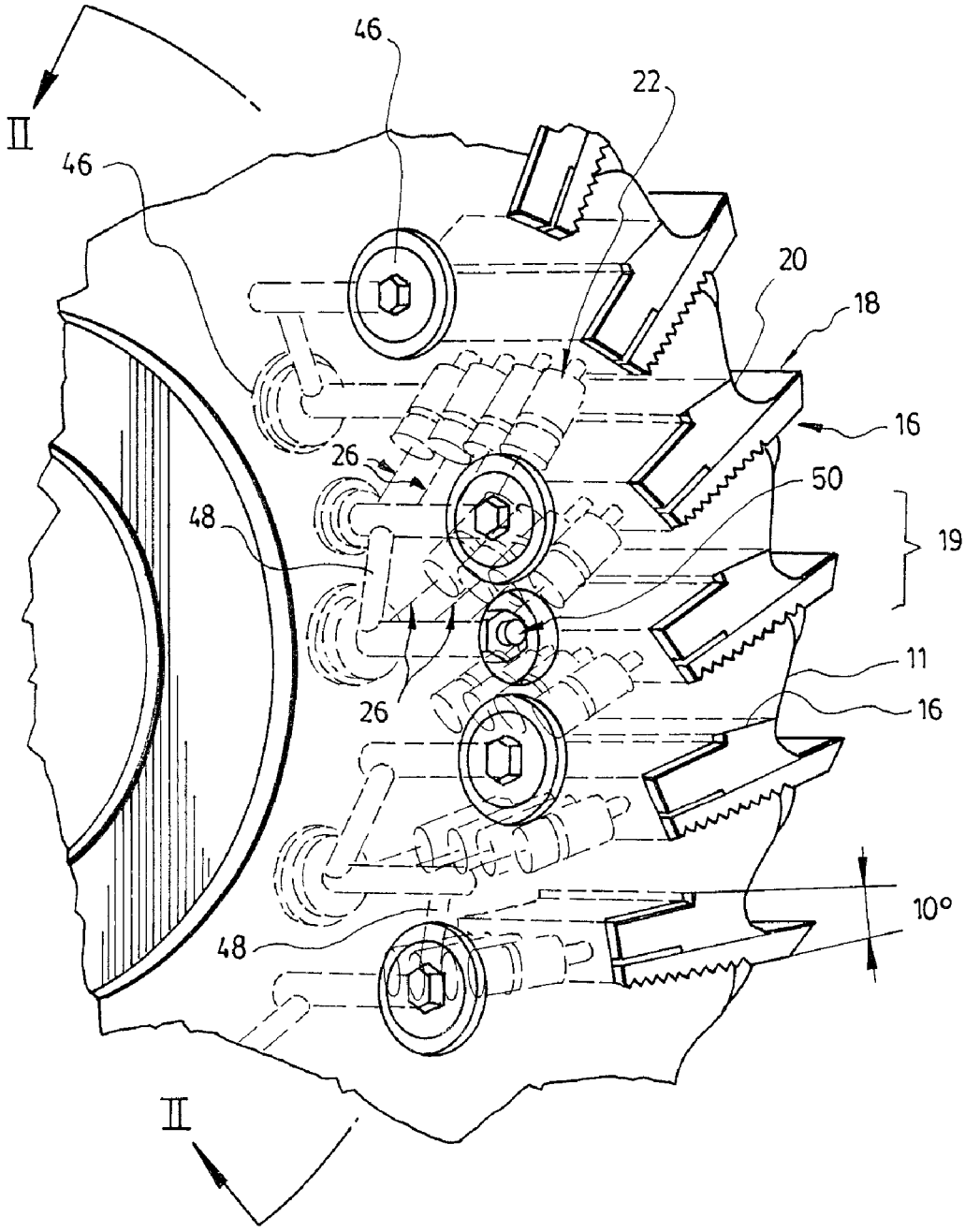
FIG. 1A is an enlargement of section A of FIG. 1.

With additional reference to the enlargement illustrated in FIG. 1A, a plurality of grooves 16 are distributed around the outer periphery of the body 12. These grooves extend transversely along the outer surface 11 of the body 12 and are configured to receive a plurality of blade assemblies 19. The expression "groove" should be considered to include any equivalent receiving portion, as will be apparent to one of ordinary skill in the art. In the illustrated embodiment, each blade assembly 19 includes a blade 18 which extends beyond the outer surface 11 for cutting a work piece (not shown) when in use, and a wedge grip 20 for retaining the blade 18 within its respective groove 16.

In a preferred embodiment, a plurality of thirty-two grooves 16, blade assemblies 19, blades 18 and wedge grips 20 are provided around the cylindrical body 12. As will be apparent to one of ordinary skill in the art, embodiments including less or more grooves 16, blade assemblies 19, blades 18 and wedge grips 20 are within the scope of the present invention, as are embodiments including differing pluralities of these elements.

As discussed above, the wedge grips 20 are able to translate in a limited fashion within their respective grooves 16 in a generally inward or outward direction. In response to the translation caused by a generally outward force applied thereto, each wedge grip 20 will engage an angled surface within a one of the grooves 16 and apply a retaining force to a corresponding one of the blades 18. As illustrated in FIGS. 1 and 1A, the blade assemblies 19 and grooves 16 are aligned with the rake angle of the blades 18. As such, the grooves do not extend in a purely radial direction with respect to the axis of rotation 13, but rather at an angle thereto. Nevertheless, the centrifugal force created during rotation of the planing head 10 will contain a component in line with the rake angle of the grooves 16 and blade assemblies 19, which will in turn result in the desired retaining force being applied by the wedge grip 20 on the blades 18, as is known in the art and will not be discussed further herein. As such, a groove provided at any such angle, or indeed any corresponding wedge grip which can translate therewithin, should be considered to be disposed in a generally outward direction.

As the wedge grip 20 translates generally outwardly, towards the periphery of the body 12, it tightens on the blade 18 to hold it solidly in place. When the planing head 10 is in rotational motion, the centrifugal force naturally pushes the wedge grip 20 generally outwardly to hold the blade 18 in place. To complement the centrifugal force and its retaining effect, a hydraulic pressure system 21 is provided to apply an additional hydraulic pressure, preferably in a generally outward direction, to the blade assemblies 19.

Figure 3:
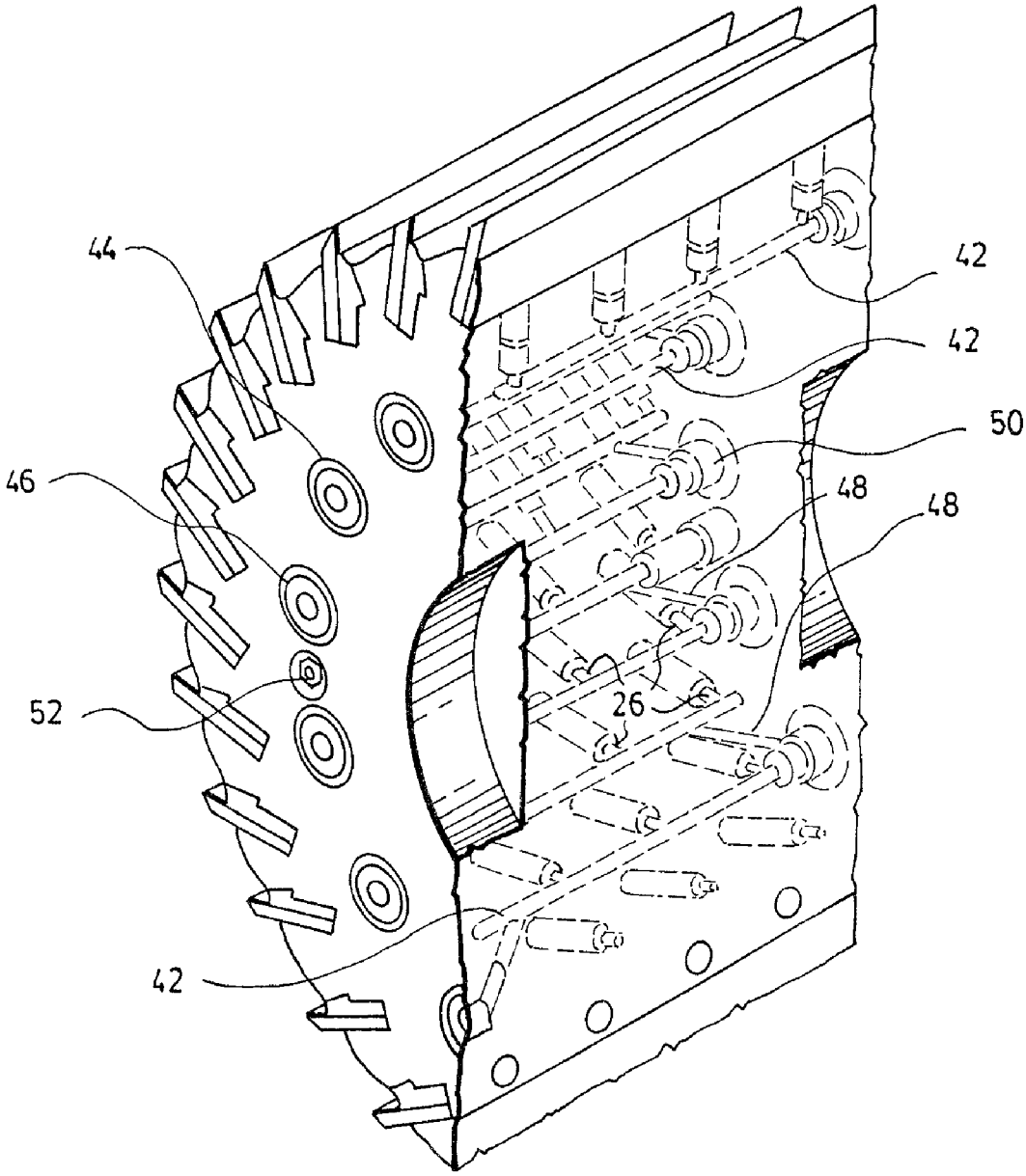
FIG. 3 is a perspective view of a cross-section along a transverse plane of the planing head of FIG. 1.

With additional reference now to FIG. 3, the hydraulic pressure system 21 includes a plurality of transverse channels 42 into which a pressurised hydraulic fluid, such as grease or oil, is inserted. The transverse channels 42 are in hydraulic communication with the grooves 16 so as to transmit the hydraulic pressure to the blade assemblies 19 and complement the centrifugal force. An inlet valve 50 and an outlet valve 52 are preferably provided to enable the transfer of the grease or oil into and out of the hydraulic pressure system 21, respectively. Preferably, the transverse channels 42 extend between the first and second end faces 15 and 17 from an opening 44 in one of the first and second end faces 15 and 17 and towards the other of the first and second end faces 15 and 17, but do not extend completely through the cylindrical body 12. It is to be noted, however, that an alternate embodiment where the transverse channels do extend completely through the cylindrical body is within the scope of the present invention. Also preferably, the plurality of transverse channels 42 are broken into two sets: a first set which extend from openings 44 in the first end face 15 and a second set which extend from openings 44 in the second end face 17. As illustrated in the Figures, these first and second sets of transverse channels 42 are disposed alternatingly on a circular locus about the axis of rotation 13, i.e. at a substantially constant radial distance from the axis of rotation 13.

A plug 46 is preferably disposed in each opening 44, so as to stop the grease from escaping from the hydraulic pressure system 21 when the planing head is in use.

A plurality of pistons 22 and connecting channels 26 may be provided between each transverse channel 42 and its corresponding groove 16. More specifically, and as illustrated in the Figures, a set of four pistons 22 and connecting channels 26 are provided between each transverse channel 42 and its corresponding groove 16. As will be apparent to one of ordinary skill in the art, the number of pistons 22 may vary in accordance with a number of factors, including the transverse length of the cylindrical body 12.

In order to link the plurality of transverse channels 42 together and evenly distribute the pressurised hydraulic fluid therebetween, the hydraulic pressure system 21 further includes a plurality of oblique channels 48. Each oblique channel 48 preferably intersects two neighbouring transverse channels 42. It intersects a first transverse channel 42 near to the opening 44 in the one of the first and second end faces 15 and 17, and a second transverse channel 42 at a point further towards the other of the first and second end faces 15 and 17. This arrangement advantageously simplifies construction of the hydraulic pressure system 21 and the planing head 10, as will be discussed in further detail below.

Figure 2:
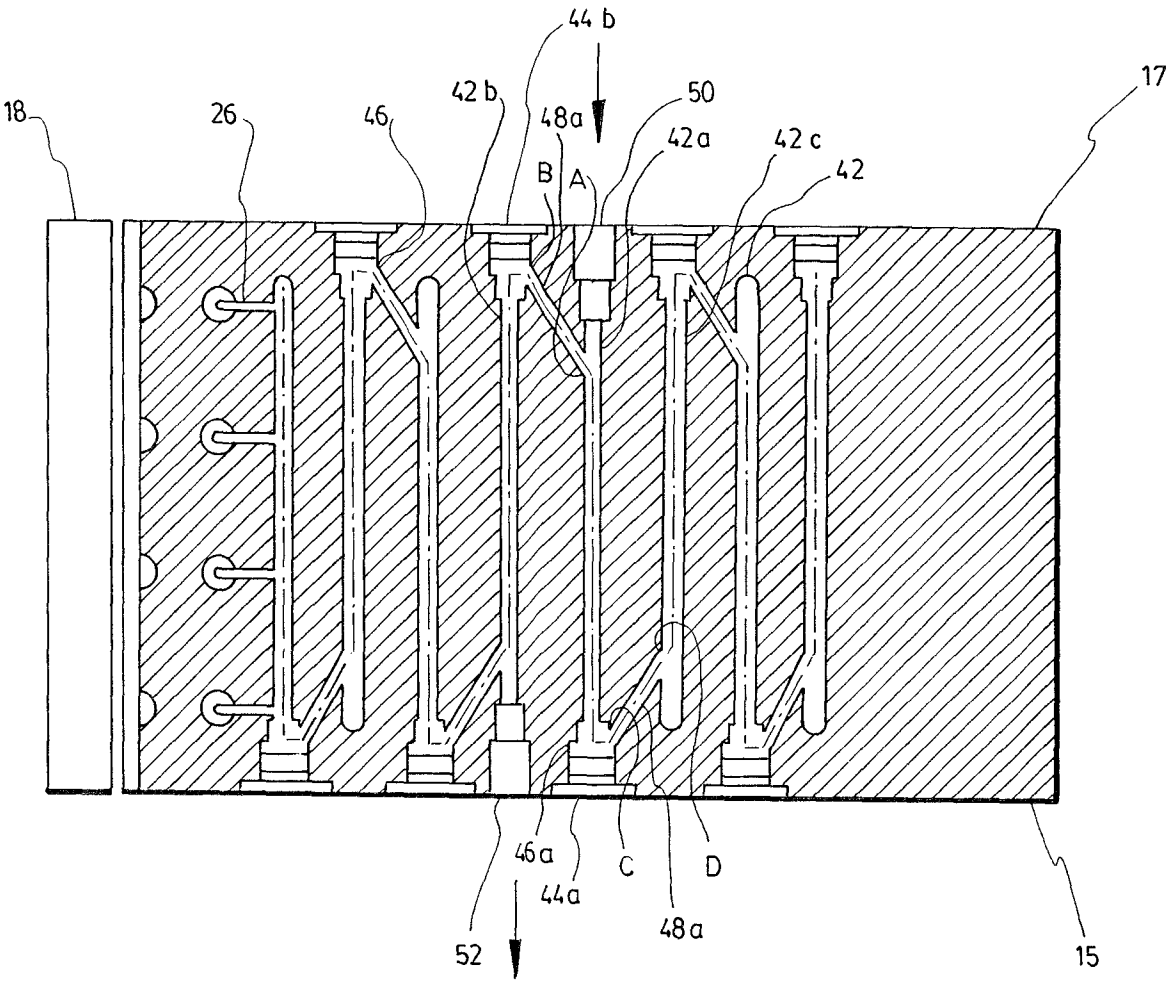
FIG. 2 is a partial cross-sectional view of the planing head of FIG. 1.

With specific reference to the preferred embodiment illustrated in FIG. 2, the distribution of the hydraulic fluid throughout the transverse and oblique channels 42 and 48, represented here in dashed lines, will be described in more detail. Prior to the first use of the planing head 10, the hydraulic fluid is introduced into the hydraulic pressure system 21 via an inlet valve 50. In the illustrated embodiment, the inlet valve 50 is located on the second end face 17 and opens into a first transverse channel 42*a*. As shown in the preferred embodiment illustrated in FIG. 2, the inlet valve 50 is located opposite the first transverse channel 42*a*'s opening 44*a* on the first end face 15.

A first oblique channel 48*a* branches off from the first transverse channel 42*a* at a junction A and intersects a second transverse channel 42*b* at a junction B, thereby allowing the hydraulic fluid, and pressure, to flow therebetween. As the hydraulic fluid flows into the second transverse channel 42*b* and onward, it also continues to flow through the transverse channel 42*a* towards the first end face 15. The hydraulic fluid is prevented from exiting the transverse channel 42*a* through the opening 44*a* by the plug 46*a*, however it is able to branch off into a third transverse channel 42*c* via a second oblique channel 48*b* which hydraulically links the first and third transverse channels 42*a* and 42*c* at junctions C and D, respectively. This pattern of neighbouring transverse 42 being linked at either end by oblique channels 48 is continued throughout the whole cylindrical body 12.

It will be noted that in the above example, the first transverse channel 42*a* is of the previously-mentioned first set of transverse channels 42 since it extends from an opening 44*a* in the first end face 15. Similarly, it will be noted that the neighbouring transverse channels 42*b* and 42*c* are of the second set of transverse channels 42 since they extend from the second end face 17. It will further be noted that the junction B between the second transverse channel 42*a* and the first oblique channel 48*a* is near the opening 44*b* while the junction A at the opposite end of the first oblique channel 48*a* is farther towards the opposite end face 15. Similarly, the second oblique channel 48*b* intersects the first transverse channel 42*a* at the third junction C which is near the opening 44*a*, and intersects the third transverse channel 42*c* at junction D which is farther towards the opposite end face 17.

The outlet valve 52 is located in the first end face 15 at an extremity of the second transverse channel 42*b* and provided to allow the controlled release of fluid from the hydraulic pressure system 21. Preferably, the outlet valve 52 is a relief valve 52 which is additionally designed to open at a preset pressure level. In this manner, the hydraulic fluid is distributed within the alternating transverse and oblique channels 42 and 48 as more hydraulic fluid is introduced via the inlet valve 50. Once the hydraulic pressure system 21 has been filled and a desired level of pressure has been reached throughout the hydraulic pressure system 21, the transfer of hydraulic fluid is ceased. Any excess hydraulic fluid pumped into the hydraulic pressure system 21 will then be expelled via the relief valve 52. In use, the generally outward pressure applied to the blade assemblies 19 to aid in retaining the blades 18 may be released by opening up the outlet valve 52 and discharging some of the hydraulic fluid. In this manner, the blades 18 and/or wedge grips 20 can be removed from their grooves 16 for, for example, maintenance, cleaning or replacement. Prior to subsequent use of the planing head 10, the blades 18 and/or wedge grips 20 can be reinserted into the grooves 16 and the hydraulic pressure system 21 then repressurised via the inlet valve 50. As will be appreciated by one of ordinary skill in the art, the transfer of hydraulic fluid into and out of the hydraulic pressure system 21 is simplified by the alternating disposition of the transverse and oblique channels 42 and 48.

In the preferred embodiment, for each blade 18 there is provided a corresponding transverse channel 42 extending underneath it. While it is even more preferable that the transverse channels 42, as well as the corresponding grooves 16 and blades 18, are parallel to the axis of rotation 13, it will be apparent to one of ordinary skill in the art that embodiments wherein these elements extend at least partially between the first and second end faces 15 and 17 but are only generally parallel to the axis of rotation 13 are nevertheless within the scope of the present invention.

Referring more particularly to FIG. 1A, the hydraulic communication between each transverse channel 42 and its corresponding groove 16 is preferably accomplished by a connecting channel 26 (illustrated in dotted lines in FIG. 1A) which extends therebetween, and a piston 22 which can translate within the connecting channel 26. Each piston 22 contacts the pressurised hydraulic fluid along an inner surface. An outer surface of each piston 22 protrudes into the groove 16 and engages the wedge grip 20 therein so as to transmit the hydraulic pressure within the transverse channel 42 to the blade assembly 19 in a generally outward direction. The translation of the pistons 22 within the connecting channels 26 is preferably aligned with the rake angle of the blades 18 and parallel to the translation of the wedge grip 20 within each groove 16. It will be understood by one of ordinary skill in the art, however, that other manners of communicating the hydraulic pressure to the blade assemblies are within the scope of the present invention.

As will be easily understood by one skilled in the art, the above-described cylindrical body 12 of a planing head 10 according to the present invention can be manufactured as from single piece of material. A cylindrical body blank (not shown) is first provided having the axis of rotation 13, the outer surface 11 around the axis of rotation 13, and the opposite first and second end faces 15 and 17. The cylindrical body blank can be moulded, cast, machined from round stock, or created in another manner as will be apparent to one of ordinary skill in the art. The plurality of transverse channels 42 are drilled or bored at least partially through the cylindrical body blank from one of the first and second end faces 15 towards the other of the first and second end faces 15 and 17. In the preferred embodiment, the first set of transverse channels 42 are bored from first end face 15 partially through the cylindrical body blank and the second set of transverse channels 42 are bored from the second end face 17 in an alternating distribution as illustrated. In an alternative embodiment, the transverse channels 42 are bored through the entire transverse length of the cylindrical body 12. In such an embodiment, the transverse channels 42 would be closed at either end face 15 and 17 with opposing plugs 46.

Subsequent to the boring of the transverse channels 42, the plurality of oblique channels 48 are bored into the cylindrical body blank from within a first transverse channel 42 at a position proximate to the one of the first and second end faces 15 and 17. The oblique channels 48 are extended until the intersect a second neighbouring transverse channel 42 at a point farther towards the other of the first and second end faces 15 and 17, thereby hydraulically linking neighbouring transverse channels 42. In order to do this, the cylindrical body blank is drilled into at oblique angles from the first and second end faces 15 and 17. In addition, it is advisable that the diameter of the oblique channels 48 be smaller than the diameter of the transverse channels 42 such that the oblique channels 48 can be bored from entirely within a transverse channel while entering the boring tool through the opening 44 without further cutting into the one of the first and second end surfaces 15 and 17.

The plurality of grooves 16 are formed in the outer surface 11 of the cylindrical body blank such that they extend between the first and second end faces 15 and 17 in a direction generally parallel to the axis of rotation 13. Preferably, the grooves 16 extend entirely between the two faces 15 and 17. The grooves 16 may be cut, milled or otherwise formed as will be apparent to one of ordinary skill in the art.

Subsequent to the forming of the grooves 16, the plurality of connecting channels 26 are bored from within a groove 16 to a corresponding transverse channel 42, thereby hydraulically linking each groove 16 to a corresponding transverse channel 42.

The inlet 50 and outlet 52 can also easily be made by piercing the corresponding end face 15 or 17 of the cylindrical body blank in alignment with one of the transverse channels 42. Alternatively, while the preferred embodiment provides that the transverse channels 42 are bored only partially through the cylindrical body blank, a subset of these channels can be drilled entirely through and closed at one end with a plug and at the other with a valve 50 or 52.

As being now better appreciated, the present invention is an improvement and presents several advantages over other related devices and/or methods known in the prior art. Indeed, the present invention is particularly advantageous in that by forming oblique channels 48 as described herein, the transverse channels 42 are hydraulically linked without need for the aforementioned two-piece construction.

Of course, numerous modifications could be made to the above-described embodiments without departing from the scope of the invention, as apparent to a person skilled in the art. While a specific embodiment of the present invention has been described and illustrated, it will be apparent to those skilled in the art that numerous modifications and variations can be made without departing from the scope of the invention as defined in the appended claims.

The invention claimed is:

1. A planing head for a planing machine comprising:

a) a cylindrical body having an axis of rotation, an outer surface around the axis of rotation, and opposite first and second end faces;

b) a plurality of blade assemblies arranged along the outer surface;

c) a plurality of grooves in the outer surface, each groove configured to receive a respective one of the plurality of blade assemblies, each groove extending along the outer surface;

d) a hydraulic pressure system for supplying a pressure to each of the blade assemblies, the hydraulic pressure system comprising:

i) a plurality of transverse channels for receiving a pressurised hydraulic fluid, each transverse channel extending at least partially through the cylindrical body from an opening in one of the first and second end faces towards the other of the first and second end faces, each transverse channel being in hydraulic communication with a corresponding groove; and ii) a plurality of oblique channels hydraulically linking the plurality of transverse channels, each oblique channel intersecting a respective first of the plurality of transverse channels proximate to the opening in the one of the first and second end faces from which the first of the plurality of transverse channels extends and intersecting a respective neighbouring second transverse channel at a point farther towards the other of the first and second end faces.

2. The planing head of claim 1, further comprising a plurality of plugs for closing each opening.

3. The planing head of claim 1, wherein each blade assembly comprises:

a) a blade;

b) a wedge grip for retaining the blade within a respective one of the grooves, the wedge grip being operable to translate within the respective groove and to apply a retaining force to the blade in response to a force applied thereto.

4. The planing head of claim 3, wherein the hydraulic communication between each transverse channel and the corresponding groove comprises:

a) a connecting channel extending between the transverse channel and the corresponding groove; and b) a piston operable to translate within the connecting channel and transmit a force from the pressurised hydraulic fluid to the wedge grip.

5. The planing head of claim 4, wherein the hydraulic communication between each transverse channel and the corresponding groove is realised by a plurality of connecting channels and a corresponding plurality of pistons therein.

6. The planing head of claim 5, comprising four of the connecting channels and four of the pistons operable to translate therein for each blade assembly.

7. The planing head of claim 1, wherein the plurality of transverse channels comprises:

a) a first set of the transverse channels extending at least partially through the cylindrical body from an opening in the first end face; and b) a second set of the transverse channels extending at least partially through the cylindrical body from an opening in the second end face.

8. The planing head of claim 7, wherein the transverse channels of the first and second sets of transverse channels are disposed alternatingly on a circular locus about the axis of rotation.

9. The planing head of claim 8, wherein each oblique channel hydraulically links a one of the first set of transverse channels with an adjacent one of the second set of transverse channels.

10. The planing head of claim 1, further comprising a hydraulic fluid inlet valve for enabling the transfer of the hydraulic fluid into the hydraulic pressure system, the hydraulic fluid inlet valve being mounted to one of the first and second end faces and in hydraulic communication with at least one of the transverse channels.

11. The planing head of claim 10, further comprising a hydraulic fluid outlet valve for enabling the transfer of pressurised hydraulic fluid out of the hydraulic fluid pressure system, the hydraulic fluid outlet valve being mounted to one of the first and second end faces and in fluid communication with at least one of the transverse channels.

12. A cylindrical body for a planing head comprising:

a) a body having an axis of rotation, an outer surface around the axis of rotation, and opposite first and second end faces;

b) a plurality of grooves in the outer surface, each groove configured to receive a blade assembly, each groove extending along the outer surface;

c) a hydraulic pressure system for supplying a hydraulic pressure to each of the plurality of grooves, the hydraulic pressure system comprising:

i) a plurality of transverse channels for receiving a pressurised hydraulic fluid, each transverse channel extending at least partially through the body from an opening in one of the first and second end faces towards the other of the first and second end faces, each transverse channel being in hydraulic communication with a corresponding groove; and ii) a plurality of oblique channels hydraulically linking the plurality of transverse channels, each oblique channel intersecting a respective first of the plurality of transverse channels proximate to the opening in the one of the first and second end faces from which it extends and intersecting a respective second transverse channel at a point farther towards the other of the first and second end faces.

13. The cylindrical body of claim 12, wherein the hydraulic communication between each transverse channel and the corresponding groove comprises a connecting channel extending between the transverse cannel and the corresponding groove.

14. The planing head of claim 13, wherein the hydraulic communication between each transverse channel and the corresponding groove is realised by a plurality of connecting channels.

15. The planing head of claim 12, wherein the plurality of transverse channels comprises:

a) a first plurality of transverse channels extending at least partially through the cylindrical body from an opening in the first end face; and b) a second plurality of transverse channels extending at least partially through the cylindrical body from an opening in the second end face.

16. The planing head of claim 15, wherein the first and second pluralities of transverse channels are disposed alternatingly on a circular locus about the axis of rotation.

17. The planing head of claim 16, wherein each oblique channel hydraulically links a one of the first plurality of transverse channels with an adjacent one of the second plurality of transverse channels.

* * * * *